US005297894A

United States Patent [19]

Yenick

[11] Patent Number: 5,297,894

[45] Date of Patent: Mar. 29, 1994

[54] MACHINE AND METHOD FOR REPETITIVELY CUTTING EQUALLY SPACED AND DIMENSIONED HIGHWAY SURFACE DEPRESSIONS

[75] Inventor: Gerald A. Yenick, Zelienople, Pa.

[73] Assignee: Safety Grooving & Grinding, Inc., Wauseon, Ohio

[21] Appl. No.: 913,553

[22] Filed: Jul. 14, 1992

[51] Int. Cl.[5] ..... E01C 23/09

[52] U.S. Cl. ..... 404/90; 404/72; 404/94; 299/38; 299/39

[58] Field of Search ..... 404/89, 93, 94, 90, 404/72; 299/36, 37, 39, 40

[56] References Cited

U.S. PATENT DOCUMENTS

| | | | |
|---|---|---|---|
| 3,094,047 | 6/1963 | Patton | 404/94 |
| 3,807,634 | 4/1974 | Vogt | 404/94 X |
| 4,701,069 | 10/1987 | Whitney | 404/94 X |
| 4,744,604 | 5/1988 | Lewis et al. | 404/90 X |
| 4,797,025 | 1/1989 | Kennedy | 404/90 |
| 4,824,516 | 4/1989 | Ishihara et al. | 404/94 X |
| 4,896,995 | 1/1990 | Simmons | 404/90 |
| 4,900,094 | 2/1990 | Sergeant | 299/39 |
| 4,909,575 | 3/1990 | Lupton | 299/39 |
| 4,938,537 | 7/1990 | Rife, Jr. et al. | 299/39 |
| 4,943,119 | 7/1990 | Zarniko et al. | 299/1 |
| 4,986,604 | 1/1991 | Meister | 299/39 |
| 5,046,890 | 9/1991 | Dickson | 404/90 |
| 5,059,061 | 10/1991 | Stenemann et al. | 404/94 X |
| 5,161,910 | 11/1992 | O'Konek | 404/90 |

*Primary Examiner*—Ramon S. Britts

*Attorney, Agent, or Firm*—Michael R. Swartz; John R. Flanagan

[57] ABSTRACT

A machine for repetitively cutting depressions of equal desired dimensions and at equal desired spacings between them in a highway surface includes a mobile chassis movable along the highway surface and having a support frame mounted for pivotal movement about a transverse axis, a cutting head mounted to the support frame for rotation about a transverse axis at a predetermined speed to cut a depression in the highway surface, an auxiliary frame pivotally connected about an axis to the support frame, gauge wheels rotatably mounted to the auxiliary frame and supporting the auxiliary frame and the support frame therewith above the highway surface, and a cam and control mechanism drivingly interconnected to the gauge wheels to repetitively pivotally move, in response to rotation of the gauge wheels, the auxiliary and support frames about the respective axes relative to one another and thereby repetitively vertically move in a preset sequence the cutting head between a lowered cutting position and raised non-cutting position relative to the highway surface, concurrently with continuous movement of the mobile chassis on the highway surface, to repetitively cut depressions in the highway surface having the substantially equal desired dimensions at the substantially equal desired spacings.

19 Claims, 11 Drawing Sheets

MACHINE AND METHOD FOR REPETITIVELY CUTTING EQUALLY SPACED AND DIMENSIONED HIGHWAY SURFACE DEPRESSIONS

BACKGROUND OF THE INVENTION

1. Field of the Invention

The present invention generally relates to equipment for cutting depressions in highway surfaces to provide ways of alerting motorists of road edges and centerlines and, more particularly, is concerned with a machine and method for repetitively cutting depressions in a highway surface having substantially equal dimensions and being substantially equally spaced apart from one another.

2. Description of the Prior Art

To make highways as safe as possible, one common practice has been to install safety markers and reflectors of various kinds along edges and centerlines of highways. These devices are designed to reflect light from a vehicle's headlights back to the driver or to make a sound when the vehicle's wheels ride over the devices, or to do both, in order to alert the driver of the vehicle's location on the highway and thereby compensate for a driver's inattention or bad driving weather.

Different machines have been proposed in the prior patent art to cut depressions in the highway surface for receiving and seating these safety markers and reflectors. Representative examples of prior art machines are disclosed in U.S. Pat. Nos. to Kennedy (4,797,025) and Sergeant (4,900,094).

The Kennedy patent discloses a self-propelled machine which has hydraulic drive wheels, a frame plate raised and lowered by a hydraulic cylinder with a piston rod, and cutter blades supported from and forwardly of the frame plate. Connected to and forward of the cutter blades are a pair of cams which rotate on the roadway and raise and lower the cutter blades into and out of cutting relation with the roadway to control the shape and length of the depression as the machine is moved forward over the roadway. Weights on the cams ensure that the cams are in proper position for the start of each cut. The cutter blades and drive wheels are interconnected and hydraulically driven by an automatic flow control circuit which functions to slow down the forward movement of the machine when the rotary cutter blades encounter difficult cutting. Thus, the cutter blades always operate at the same optimum cutting speed and efficiency, while the cams control the shape and length of the depression as the machine is moved forward over the roadway.

The Sergeant patent discloses a machine in the form of a framework attached to the rear of a truck, a pair of spaced apart cutters, and an arm and cylinder pivotally mounted on the framework and supporting the plunge cutters. The cylinder is operable for raising and lower the cutters relative to the roadway. Water and air supplies are directed at the cutters to cool and lubricate the cutters and clean out the depressions made in the roadway.

More recently, a growing number of highway authorities have decided to add depressions called "rumble strips" along the side edges of the highway so as to alert drivers that they are approaching the edges of the road. These rumble strips take the form of a series of depressions in the highway surface which do not employ safety markers or reflectors. Instead, the dimensions of and spacing between the depressions are very precisely designed to produce a repetitive noise when ridden over by a vehicle wheel which is sufficiently audible to awaken a motorist who has fallen asleep. For instance, the dimensions of each depression is sixteen inches in width, seven inches in length, and one-half inch in depth. The spacing between adjacent depressions is five inches. Also, the profile of the depressions must be uniform from one to the next and the depressions aligned the same with the edge of the road.

A machine for fabricating highway rumble strips must be capable of cutting depressions in a repeatable and reliable manner having the prescribed precise dimensions and spacing. The machines of the Kennedy and Sergeant patents, are incapable of doing so. Consequently, a need still exists for improvements in techniques for cutting depressions in highway surfaces which will provide the repeatability and precision requires to make rumble strips that meet highway standards.

SUMMARY OF THE INVENTION

The present invention provides a machine and method for repetitively cutting equally spaced and dimensioned highway surface depressions being designed to satisfy the aforementioned needs The machine and method of the present invention are capable of cutting a series of rumble strips or depressions in a highway surface in a repeatable and reliable manner in which each depression is the same given size and profile and the series of depressions are automatically spaced apart the same precise distance.

Accordingly, the present invention is directed to a machine for repetitively cutting depressions of substantially equal desired dimensions and at equal desired spacings between the depressions in a highway surface. The cutting machine comprises: (a) a mobile chassis for continuously moving in a given direction on a highway surface; (b) a cutter mechanism supported on the mobile chassis for undergoing movement toward and away from the highway surface and having a cutting head continuously rotatable about an axis extending transversely to the given direction of movement of the mobile chassis and capable of cutting a depression in the highway surface; (c) means engaging the highway surface for continuously gauging the movement of the mobile chassis; and (d) means for repetitively moving the continuously rotating cutting head in a preset sequence, in response to the continuous gauging of the movement of the mobile chassis by the gauging means, between a lowered cutting position and raised noncutting position relative to the highway surface to repetitively cut depressions in the highway surface having the substantially equal desired dimensions at the substantially equal desired spacings.

More particularly, the mobile chassis includes an elongated primary frame, spaced apart front and rear wheels rotatably mounted to and movably supporting the main frame above the highway surface for movement along on the highway surface, and a secondary frame pivotally connected to the primary frame between and spaced from the front and rear wheels. The cutting head is mounted to the secondary frame for rotation about the transverse axis. The cutter mechanism also includes drive means mounted to the secondary frame and drivingly interconnected to the cutting head for rotatably driving the cutting head at a predetermined speed to cut the depression in the highway surface.

The gauging means includes an auxiliary frame pivotally connected to the secondary frame and at least one ground-supported gauge wheel rotatably mounted to and supporting the auxiliary frame and thereby also the secondary frame above the highway surface. The repetitively moving means includes control means mounted to the secondary frame for adjustable presetting an initial position of the auxiliary frame relative to the secondary frame and thereby of the cutting head above the highway surface. The repetitively moving means also includes at least one cam rotatably mounted to the auxiliary frame and engaged at a periphery of the cam with the control means. The cam also is drivingly interconnected to and rotatably driven by the gauge wheel relative to the control means to cause pivotal movement of the auxiliary and secondary frames about the respective axes and thereby generally vertical movement of the cutting head between the lowered cutting position and raised non-cutting position in response to rotation of the gauge wheel concurrently with continuous movement of the mobile chassis on the highway surface.

The cam periphery has at least a first portion defining a first displaced position of the auxiliary frame and secondary frame relative to one another and to the primary frame and thereby defining the lowered cutting position of the cutting head relative to the highway surface. The cam periphery also has at least a second portion circumferentially spaced from the first portion and defining a second displaced position of the auxiliary frame and secondary frame relative to one another and to the primary frame and thereby defining the raised non-cutting position of the cutting head relative to the highway surface.

The control means includes a cam follower and an actuator mounted to the secondary frame and rotatably mounting the cam follower to engage the periphery of the cam. The actuator is operable for adjustable moving the cam follower toward and away from the cam periphery to dispose the cam follower at a given stationary position relative to the cam.

The present invention also is directed to a method for repetitively cutting depressions of substantially equal desired dimensions and at equal desired spacings between the depressions in a highway surface. The cutting method comprises the steps of: (a) continuously moving in a given direction on a highway surface a mobile chassis supporting a cutter mechanism having a cutting head rotatable about an axis extending transversely to the given direction and capable of cutting a depression in the highway surface; (b) concurrently with continuous movement of the mobile chassis, continuously rotating the cutting head relative to the mobile chassis about the transverse axis; (c) continuously gauging the movement of the mobile chassis; and (d) repetitively moving, in response to the gauging of the continuous movement of the mobile chassis, the continuously rotating cutting head in a preset sequence between a lowered cutting position and raised non-cutting position relative to the highway surface to repetitively cut depressions in the highway surface having the substantially equal desired dimensions at the substantially equal desired spacings.

More particularly, the movement of the mobile chassis is gauged by engaging a rotatable gauge wheel with the highway surface to cause rotation of the wheel in correspondence with the movement of the chassis. Further, the preset sequence defining the repetitive movement of the cutting head is defined by circumferentially displaced peripheral portions of the periphery of at least one cam being rotatably driven by rotation of the gauge wheel.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
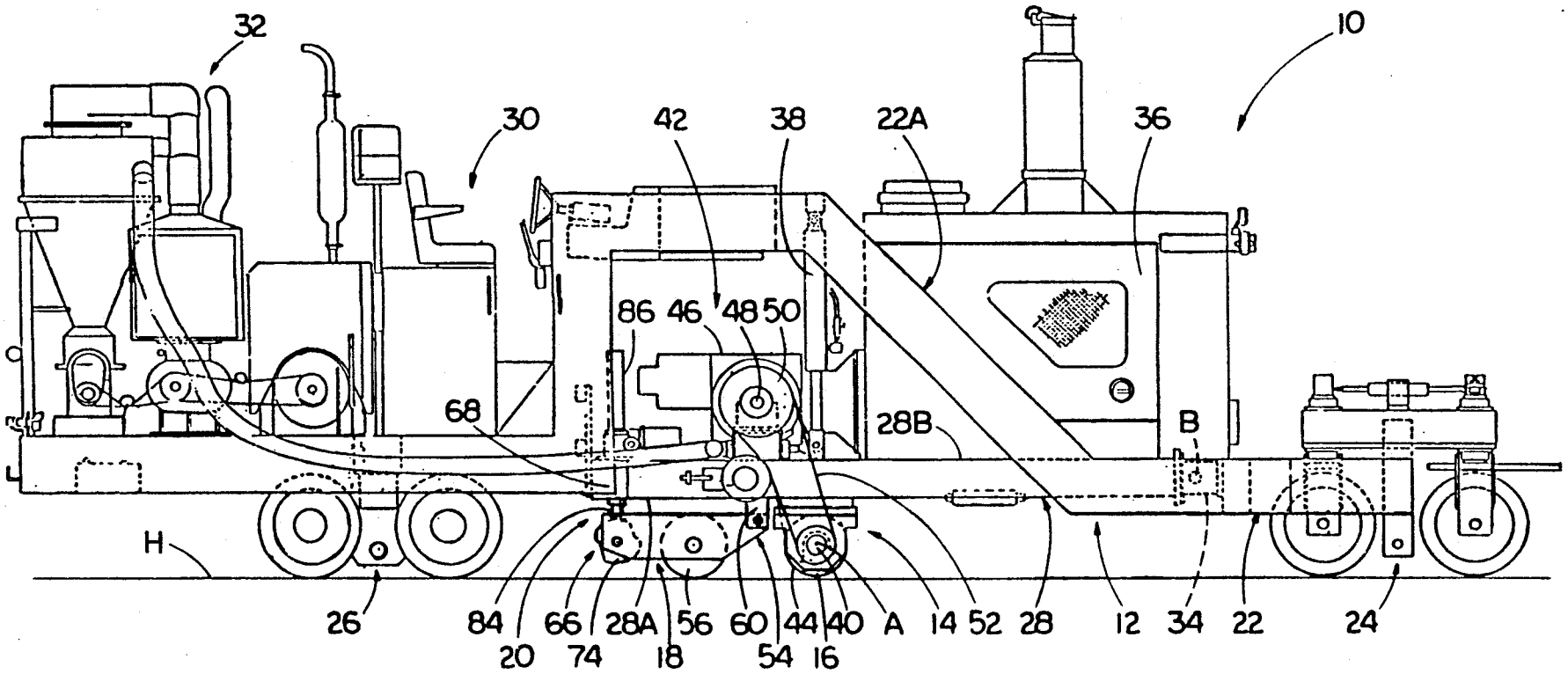
FIG. 1 is a side elevational view of a machine in accordance with the present invention for repetitively cutting depressions of equal dimensions and at equal spacings in a highway surface.
Figure 2:
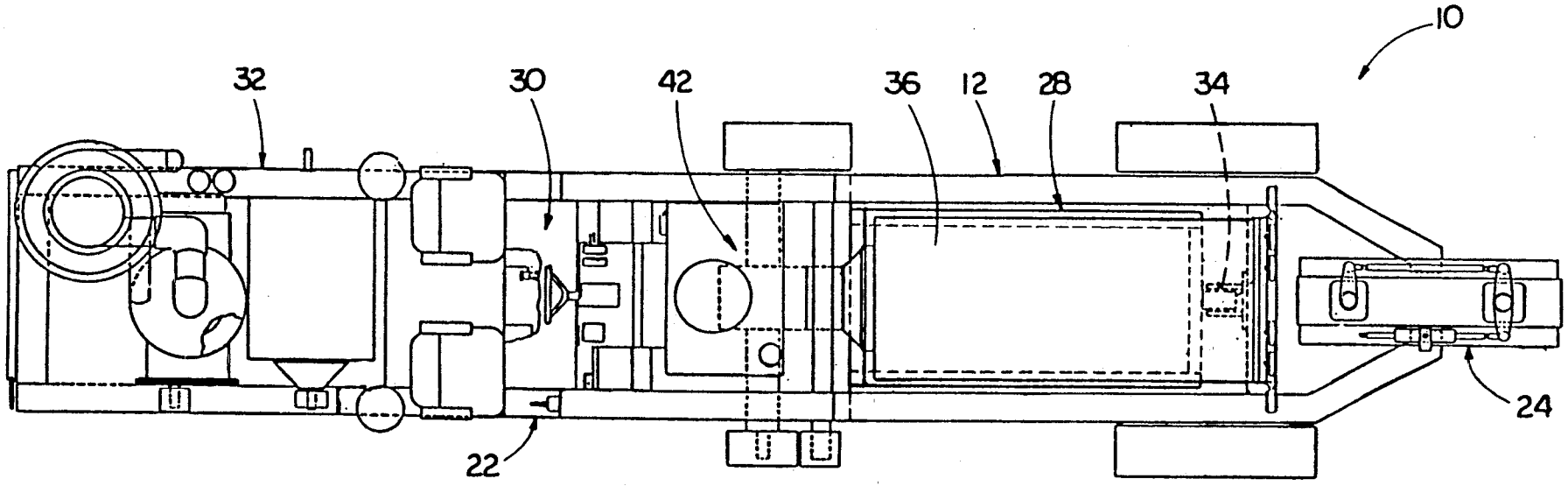
FIG. 2 is a top plan view of the depressions cutting machine of FIG. 1.
Figure 3:
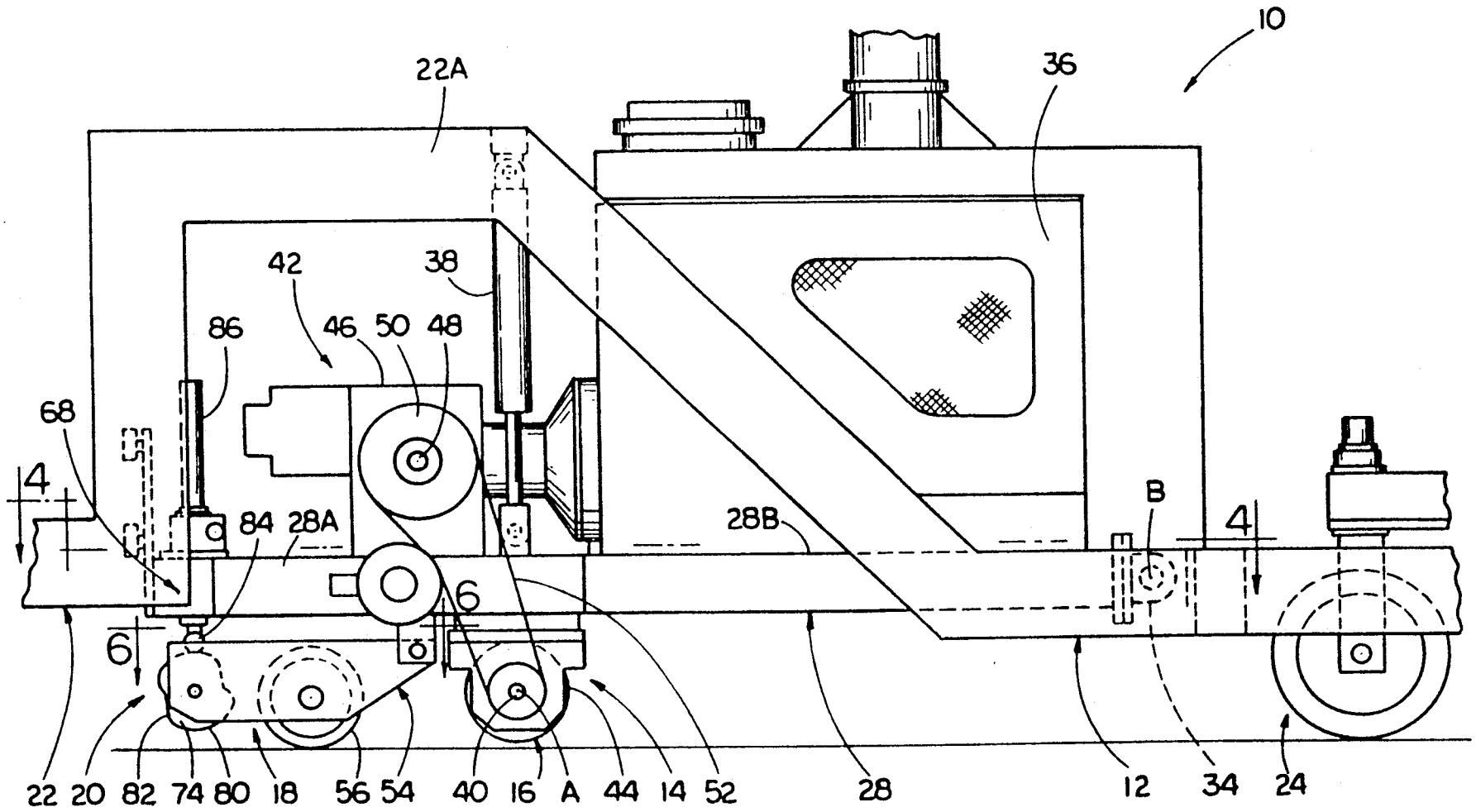
FIG. 3 is an enlarged view of a fragmentary portion of the cutting machine of FIG. 1.
Figure 4:
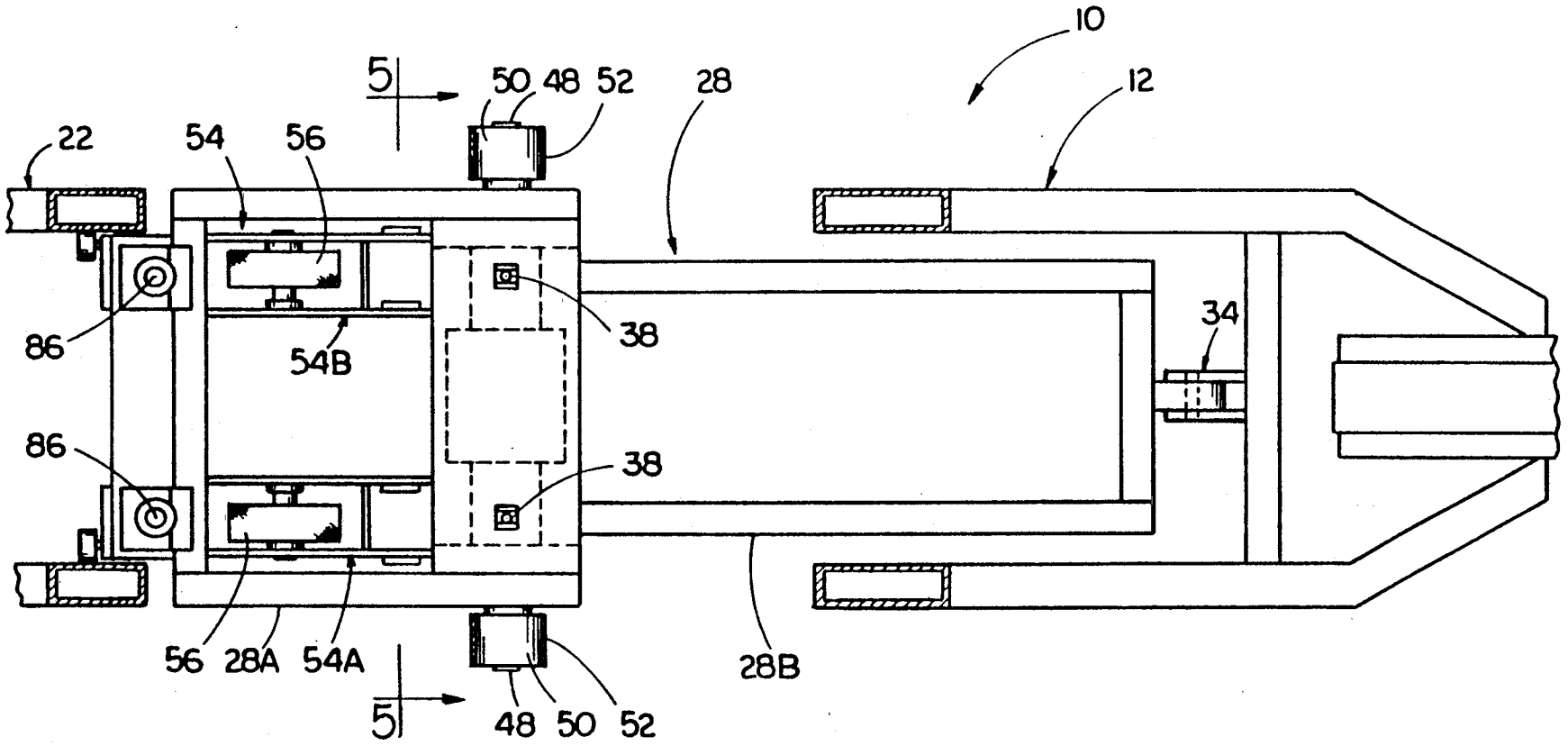
FIG. 4 is a top plan view, partly in section, of the cutting machine as seen along line 4—4 of FIG. 3.
Figure 5:
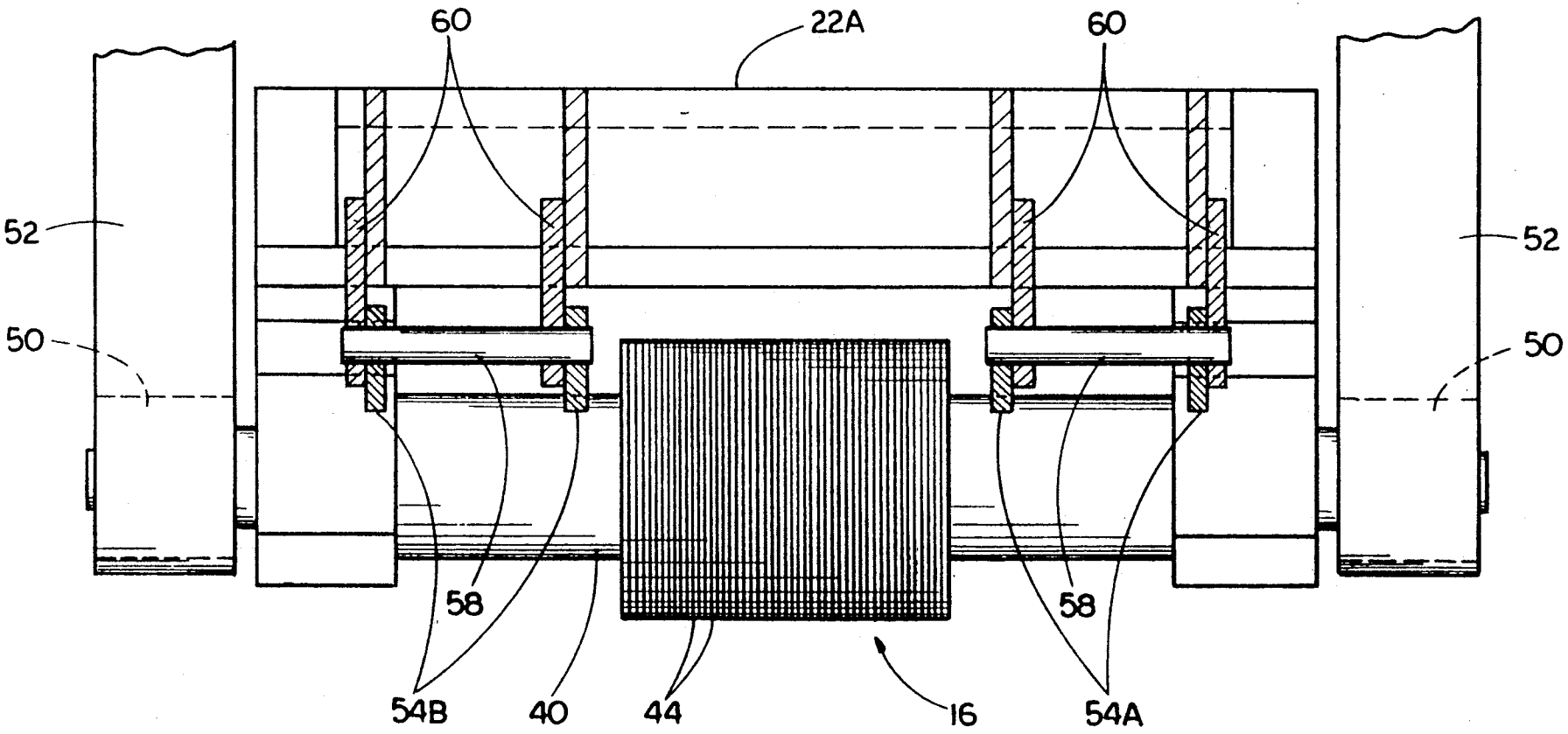
FIG. 5 is a vertical elevational view, partly in section, of the cutting machine as seen along line 5—5 of FIG. 4.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Figure 13:
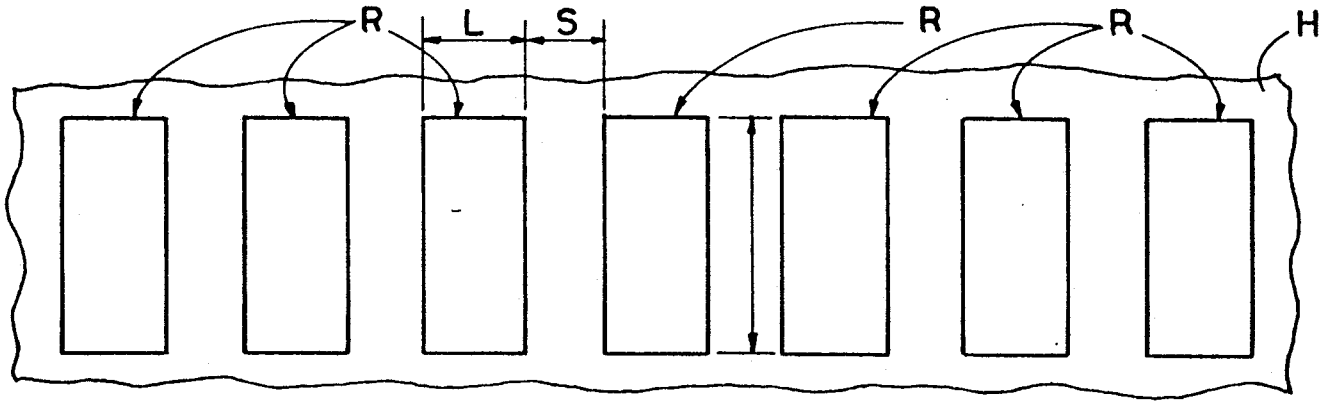
FIG. 13 is a top plan view of a series of depressions cut into a highway surface having equal dimensions and at equal spacings from one another.
Figure 14:
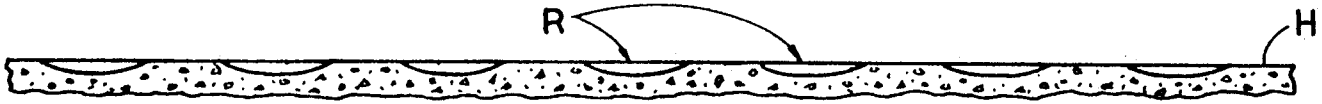
FIG. 14 is a vertical sectional view of the series of depressions taken along line 14—14 of FIG. 13.
Figure 15:
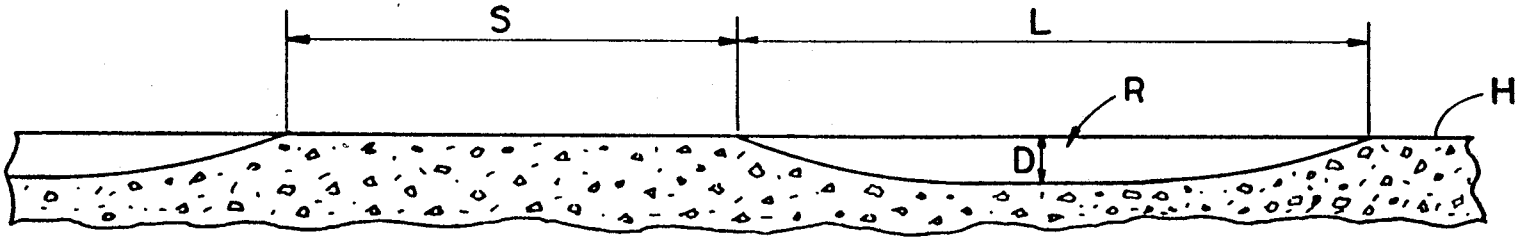
FIG. 15 is an enlarged view of a fragmentary portion of the series of spacings of FIG. 14.

Referring now to the FIGS. 1-4 of the drawings, there is shown a machine, generally designated 10, for repetitively cutting a series of rumble strips or depressions R in a highway surface H in accordance with the principles of the present invention. The cutting machine 10 is capable of repetitively cutting the rumple strips or depressions R with equal desired dimensions, i.e., lengths "L", widths "W", and depths "D", and at equal desired spacings "S" between one another, as seen in FIGS. 13-15.

Basically, the depression cutting machine 10 includes a mobile chassis 12 movable in a given direction on the highway surface H, a cutter mechanism 14 supported on the mobile chassis 12 for undergoing movement toward and away from the highway surface S and having a cutting head 16 rotatable about an axis A extending transversely to the given direction of movement of the mobile chassis 12 and capable of cutting the depressions R in the highway surface H, a gauging mechanism 18 for engaging the highway surface H and continuously gauging the movement of the mobile chassis 12, and a control mechanism 20 for repetitively moving the rotating cutting head 16 relative to the highway surface H in response to the gauging of the continuous movement of the mobile chassis 12. The control mechanism 20 is operable to repetitively move the cutting head 16 in a preset sequence between a raised non-cutting position, being shown in FIG. 7, and a lowered cutting position, being shown in FIG. 8, and thereby repetitively cut the series of depressions R in the highway surface H having the equal desired dimensions L, W, D and at the equal desired spacings S.

The mobile chassis 12 of the cutting machine 10 includes an elongated primary frame 22 and a front set of steering wheels 24 and a rear set of driving wheels 26 being longitudinally spaced apart and rotatably mounted to the primary frame 22. The wheels 24, 26 support the primary frame 22 above the highway surface H for movement along the highway surface. The primary frame 22 has an elevated portion 22A located between the front and rear sets of wheels 24, 26. The mobile chassis 12 also includes a secondary frame 28 disposed in generally underlying orientation to the elevated portion 22A of the primary frame 22 and located between and spaced from the front and rear sets of wheels 24, 26. Rearwardly of the elevated frame portion 22A and the secondary frame 28, the primary frame 22 supports an operator's station 30 and various equipment 32 for supplying a spray of water and a vacuum to the location where cutting of the highway surface H is taking place. The water spray is used to blow out chips and other debris from the depressions, while the vacuum is used to gather and transfer the chips and debris to a collection bin on the machine 10.

The secondary frame 28 of the mobile chassis 12 is pivotally connected at a forward end by a pivotal connection 34 to a forward end of the primary frame 22. The cutter mechanism 14 is mounted to a rearward portion 28A of the secondary frame 28. A power plant 36, preferably a diesel engine, for driving the rear set of wheels 26 is mounted upon a forward portion 28B of the secondary frame 28. The primary and secondary frames 22, 28 are interconnected by actuator means in the form of a pair of hydraulic cylinders 38 which are operable for pivotally moving the secondary frame 28 relative to the primary frame 22 about a transverse horizontal axis B defined at pivotal connection 34. Such pivoting of the secondary frame 28 relative to the primary frame 22 will move the cutting head 16 between a lowered operative condition, being shown in FIGS. 7 and 8, and a raised inoperative condition, being shown in FIG. 9.

Referring to FIGS. 1-5, the cutter mechanism 14 of the cutting machine 10 also includes a transverse shaft 40 mounting the cutting head 16 and a drive means 42 drivingly interconnected to the cutting head shaft 40 for rotatably driving the cutting head 16 at a desired predetermined speed suitable to cut the depression R in the highway surface H. The cutting head 16 is formed by a bank of circular cutting discs or blades 44 located intermediately along the shaft 40 between the opposite ends thereof. The drive means 42 includes a drive transmission 46 drivingly coupled to the power plant 36 and having oppositely extending output drive shafts 48. The drive means 42 also includes arrangements of pulleys 50 and drive belts 52 mounted to and drivingly interconnecting the respective opposite ends of the cutting head shaft 40 and the output drive shafts 48.

Referring to FIGS. 1 and 3-9, the gauging mechanism 18 of the cutting machine 10 includes an auxiliary frame 54 pivotally connected to the secondary frame 28, and at least one and preferably a pair of ground-supported gauge wheels 56 rotatably mounted to and supporting the auxiliary frame 54 and thereby the rear portion 28A of the secondary frame 28 above the highway surface H. The auxiliary frame 54 includes right and left pairs of frame members 54A, 54B which are separately pivotally mounted at their forward ends by shafts 58 to respective brackets 60 attached to the rearward portion 28A of the secondary frame 28. The respective gauge wheels 56 are rotatably mounted between the pairs of frame members 54A, 54B intermediately between the opposite ends thereof. An elongated shaft 62 extends between the gauge wheels 56 and is interconnected thereto by universal joints 64 to permit vertical movement of the wheels 56 independent of one another to compensate for unevenness of the highway surface.

Referring to FIGS. 1 and 3-12, the control mechanism 20 of the machine 10 includes a camming arrangement 66 rotatably mounted to a rear end of the auxiliary frame 54 and control means 68 mounted to the rear end of the secondary frame 28 for adjustable presetting an initial position of the auxiliary frame 54 relative to the secondary frame 28 and thereby of the cutting head 16 above the highway surface H. The camming arrangement 66 includes at least one and preferably a pair of cam shafts 70 rotatably mounted to the rear ends of the pairs of frame members 54A, 54B of the auxiliary frame 54, at least one and preferably a pair of chain drives 72 extending between and drivingly interconnecting the gauge wheels 56 and cam shafts 70, and at least one and preferably a pair of generally circular cams 74 attached on the cam shafts 70 for rotation therewith. A hydraulic motor 76 is mounted to one of the pairs of frame members 54A of the auxiliary frame 54 and drivingly coupled to one of the cam shafts 70 for providing a power drive assist to the drive relationship between the gauge wheels 56 and the cams 74. Also, an elongated universal shaft 78 extends between and interconnects the cam shafts 70 to transmit the power drive assist to both cam shafts while compensating for any relative vertical movement between the rear ends of the frame members 54A, 54B of the auxiliary frame 54.

The cams 74 are engaged at their respective peripheries 74A with the control means 68 such that as the cams 74 are rotatably driven by the gauge wheels 56 relative to the control means 68, they cause pivotal movement of the auxiliary frame 54 in one rotational sense about the gauge wheels 56 and pivotal movement of the secondary frame 28 in an opposite rotational sense about its pivotal connection 34. Such pivotal movements of the auxiliary and secondary frames 54, 28 result in generally vertical movement of the cutting head 16 between the raised non-cutting position of FIG. 7 and the lowered cutting position of FIG. 8. Since rotation of the gauge wheels 56 is in response to continuous movement of the mobile chassis 12 on the highway surface H, the rotation of the cams 74 and vertical movement of the cutting head 16 thus occur concurrently with the continuous movement of the machine 10 on the highway surface.

Figure 7:
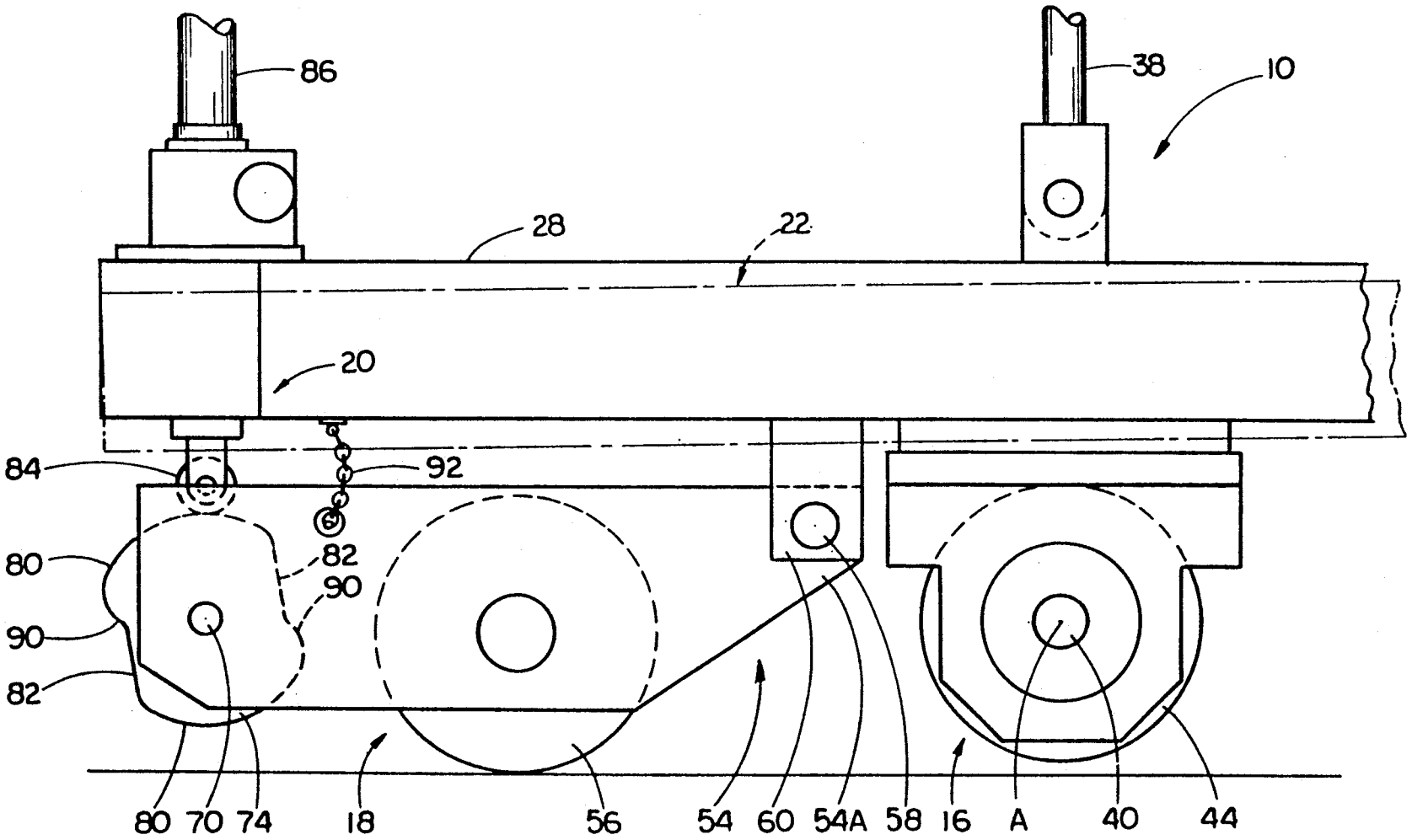
FIG. 7 is an enlarged view of a fragmentary portion of the cutting machine of FIG. 3, showing a cutting head of the machine in a lowered operative condition but raised non-cutting position relative to the highway surface.
Figure 8:
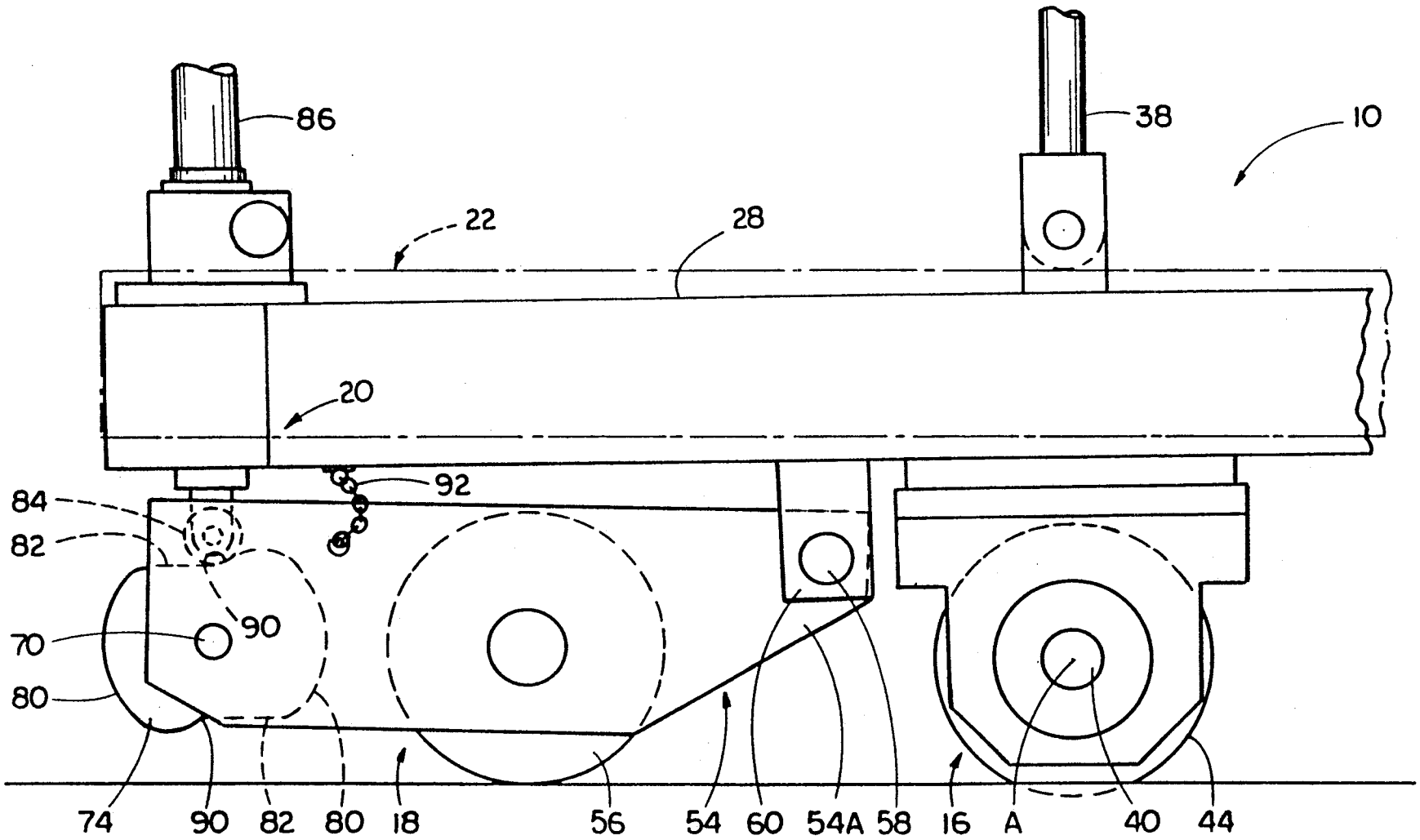
FIG. 8 is a view similar to that of FIG. 7, but showing the cutting head of the machine in the lowered operative condition and a lowered cutting position relative to the highway surface.
Figure 9:
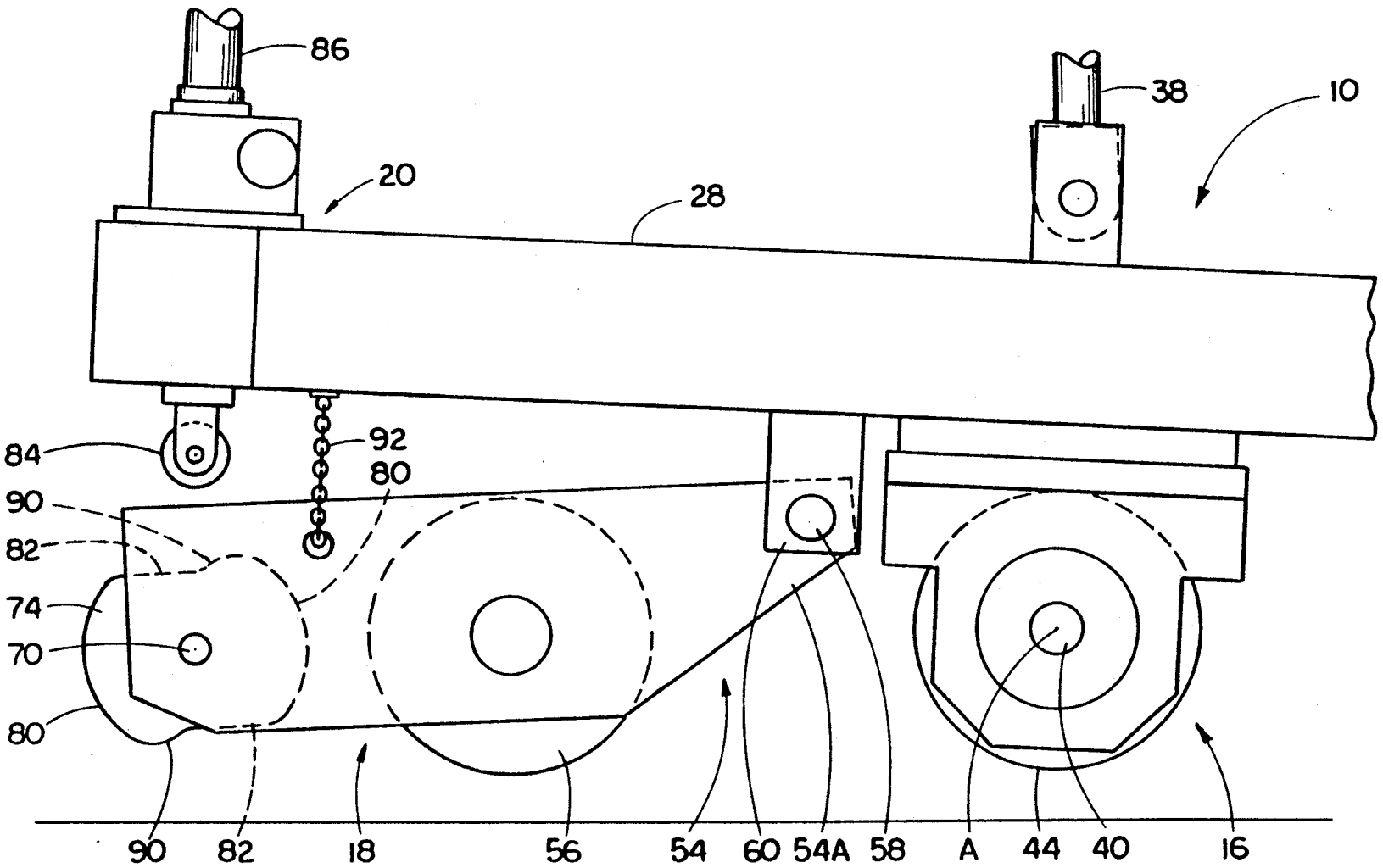
FIG. 9 is a view similar to that of FIG. 8, but showing the cutting head of the machine in a raised inoperative condition relative to the highway surface.
Figure 12:
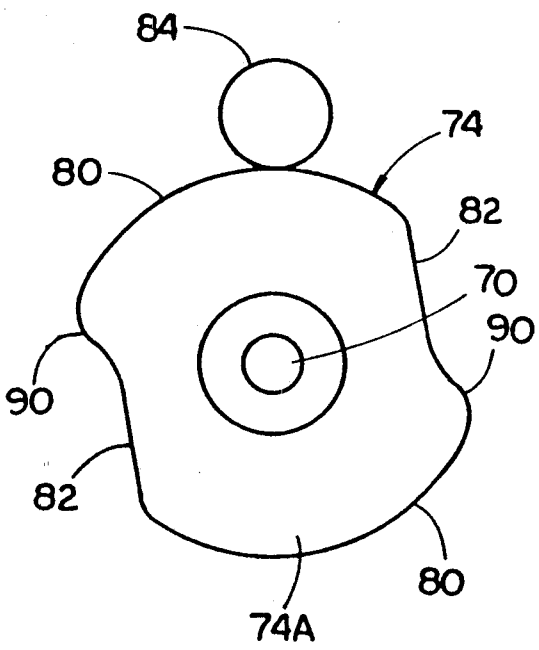
FIG. 12 is a view similar to that of FIG. 11, but showing the relative positions of the cam and cam follower during the interval between cutting depressions in the highway surface.
Figure 11:
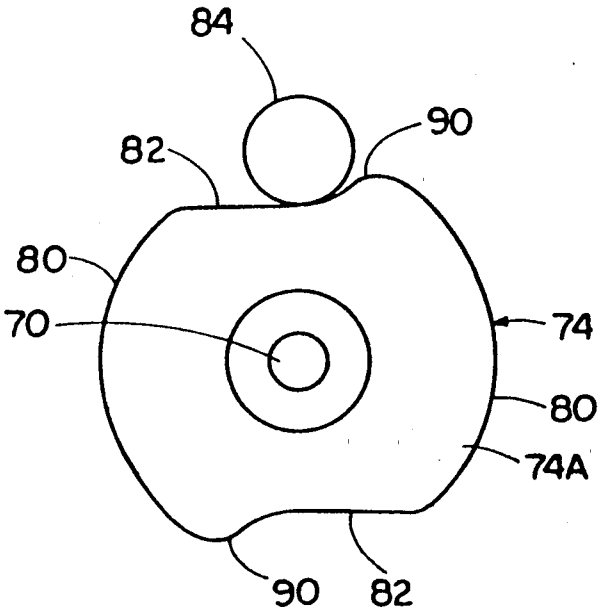
FIG. 11 is a view similar to that of FIG. 10, but showing the relative positions of the cam and cam follower at the end of cutting a depression by the cutting head in the highway surface.
Figure 10:
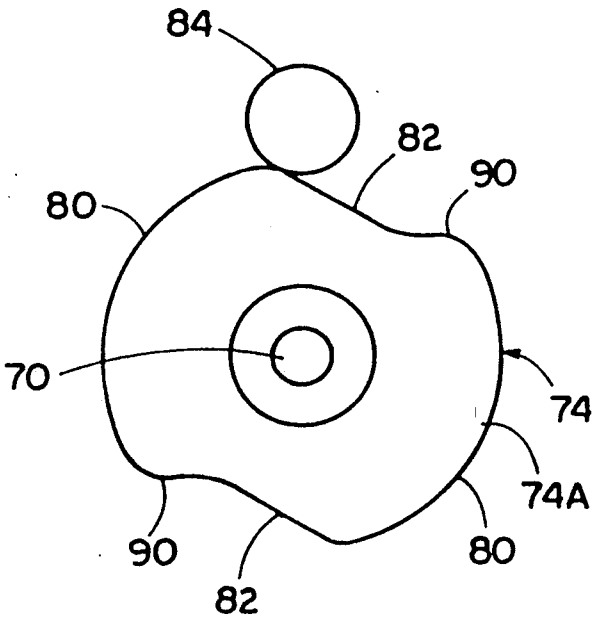
FIG. 10 is an enlarged side elevational view of a cam and cam follower of the machine of FIG. 3, showing their relative positions at the start of cutting a depression by the cutting head in the highway surface.

The periphery 74A of the cam 74 has at least one and preferably a pair of first portions 80 profiled, as shown in FIGS. 7-12, to define first angularly displaced positions of auxiliary frame 54 and the secondary frame 28 relative to one another and to the primary frame 22 and thereby define the raised noncutting position of the cutting head 16 relative to the highway surface, as seen in FIG. 7. The cam periphery 74A also has at least one and preferably a pair of second portions 82 disposed in alternating circumferential relationship with the first portions 80 and profiled, as shown in FIGS. 7-12, to define second angularly displaced positions of the auxiliary frame 54 and the secondary frame 28 relative to one another and to the primary frame 22 and thereby define the lowered cutting position of the cutting head 16 relative to the highway surface, as seen in FIG. 8. FIG. 10 shows an initial position of the cam 74 relative to the cam follower 84 at the start of cutting a depression R by the cutting head 16 in the highway surface H. FIG. 11 show a successive position of the cam 74 relative to the cam follower 84 at the end of cutting the depression R. FIG. 12 shows a position of the cam 74 relative to the cam follower 84 during the interval between cutting depressions R in the highway surface H.

Referring to FIGS. 1, 3, 4 and 7-9, the control means 68 of the control mechanism 20 includes at least one and preferably a pair of cam followers 84 and at least one and preferably a pair of actuators 86, such as linear screw actuators, mounted at the opposite corners of the rear end of the secondary frame 28 and rotatably mounting the cam followers 84 at the lower ends of the actuators 86. The cam followers 84 are positioned to engage with the respective peripheries 74A of the cams 74. The actuators 86 are hydraulically operated to adjustable vertically move the cam followers 84 toward and away from the cams 74 to dispose the cam followers 84 at desired stationary positions relative thereto.

Figure 6:
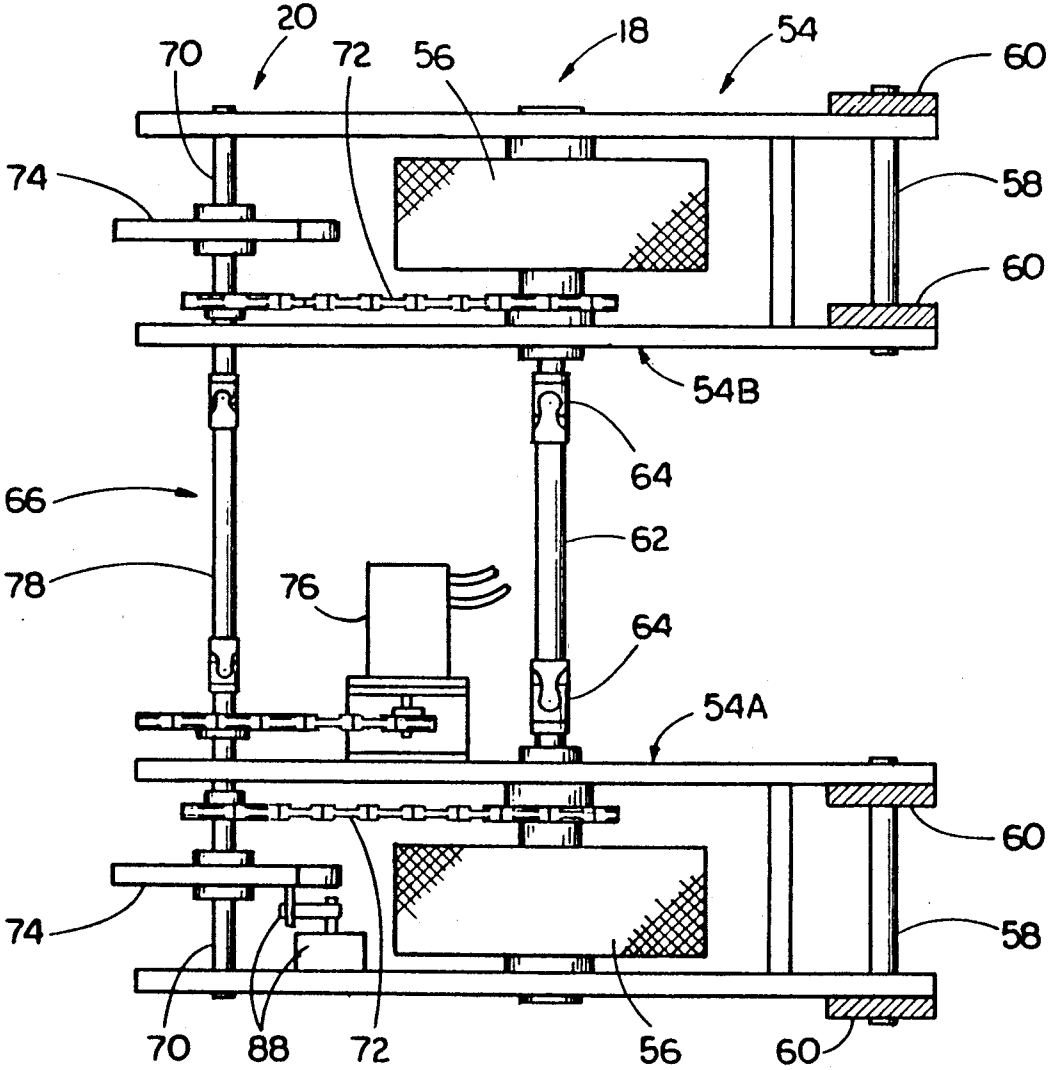
FIG. 6 is an enlarged top plan view, partly in section, of a portion of the cutting machine as seen along line 6—6 of FIG. 3.

It will noted in FIG. 6 that an electric trip switch 88 is provided on the one pair of frame members 54A of the auxiliary frame 54 adjacent the corresponding one of the cams 74. The trip switch 88 is connected to the respective actuators 86 for causing momentary operation thereof as the cam followers 84 reach the steepest sectors 90 on the peripheries 74A of the cams 74. Such operation of the actuators 86 slightly lifts the cam followers 84 away from the cams 74 so as to prevent impeding of the continuous rotation of the cams 74 by the gauge wheels 56 at these steep sectors 90 on the cam peripheries 74A. It will also be noted in FIGS. 7-9 that a flexible chain 92 extends between the auxiliary and secondary frames 54, 28. The length of the chain 92 is selected to automatically lift the auxiliary frame 54 with the secondary frame 28 when the hydraulic cylinders 38 are actuated to raise the secondary frame 28 and the cutting head 16 to the inoperative condition shown in FIG. 9.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A machine for repetitively cutting depressions of substantially equal desired dimensions and at equal desired spacings between the depressions in a highway surface, said machine comprising:

(a) a mobile chassis for continuously moving in a given direction on a highway surface;

(b) a cutter mechanism supported on said mobile chassis for undergoing movement toward and away from the highway surface and having a cutting heat continuously rotatable about an axis extending transversely to the given direction of movement of said mobile chassis and capable of cutting a depression in the highway surface;

(c) rotatable means engaging the highway surface for continuously gauging the continuous movement of said mobile chassis and undergoing rotation in response to gauging of said movement of said mobile frame; and (d) means for repetitively moving said continuously rotating cutting heat in a preset sequence, in response to the continuous gauging of the movement of said mobile chassis by said rotatable gauging means, between a lowered cutting position and raised non-cutting position relative to the highway surface to repetitively cut depressions in the highway surface having the substantially equal desired dimensions at the substantially equal desired spacings, said repetitively moving means including (i) control means mounted to said mobile chassis for adjustably presetting an initial position of said cutter mechanism and thereby said cutting heat thereof above the highway surface, and (ii) at least one cam rotatably mounted to said mobile chassis and engaged at a periphery of said cam with said control means, said cam being drivingly interconnected to and rotatably driven by said rotatable gauging means relative to said control means to cause said generally vertical movement of said cutting head between said lowered cutting position and raised non-cutting position in response to rotation of said rotatable gauging means concurrently with continuous movement of said mobile chassis on the highway surface.

2. The machine as recited in claim 1, wherein said mobile chassis includes:

an elongated primary frame; and spaced apart front and rear wheels rotatably mounted to and movably supporting said primary frame above the highway surface for movement on the highway surface.

3. The machine as recited in claim 2, wherein said mobile chassis includes a secondary frame pivotally connected to said primary frame between and spaced from said front and rear wheels.

4. The machine as recited in claim 3, wherein said cutter mechanism and said cutting head thereof are mounted to said secondary frame.

5. The machine as recited in claim 4, wherein said cutter mechanism includes drive means mounted to said secondary frame and drivingly interconnected to said cutting head for rotatably driving said cutting head at a predetermined speed to cut the depression in the highway surface.

6. The machine as recited in claim 4, wherein said gauging means includes:

an auxiliary frame pivotally connected to said secondary frame; and at least one ground-supported gauge wheel rotatably mounted to and supporting said auxiliary frame and thereby said secondary frame above the highway surface.

7. A machine for repetitively cutting depressions of substantially equal desired dimensions and at equal desired spacings between the depressions in a highway surface, said machine comprising:

(a) a mobile chassis for continuously moving in a given direction on a highway surface, said mobile chassis including an elongated primary frame, spaced apart front and rear wheels rotatably mounted to and movably supporting said primary frame above the highway surface for movement on the highway surface, and a secondary frame pivotally connected to said primary frame between and spaced from said front and rear wheels;

(b) a cutter mechanism supported on said secondary frame for undergoing movement toward and away from the highway surface, said cutter mechanism having a cutting head continuously rotatable about an axis extending transversely to the given direction of movement of said mobile chassis and capable of cutting a depression in the highway surface;

(c) means engaging the highway surface for continuously gauging the continuous movement of said mobile chassis, said gauging means including an auxiliary frame pivotally connected to said secondary frame, and at least one ground-supported gauge wheel rotatably mounted to and supporting said auxiliary frame and thereby said secondary frame above the highway surface; and (d) means for repetitively moving said continuously rotating cutting head in a preset sequence, in response to the continuous gauging of the movement of said mobile chassis by said gauging means, between a lowered cutting position and raised non-cutting position relative to the highway surface to repetitively cut depressions in the highway surface having the substantially equal desired dimensions at the substantially equal desired spacings, said repetitively moving means including control means mounted to said secondary frame for adjustably presetting an initial position of said auxiliary frame relative to said secondary frame and thereby of said cutting heat above the highway surface, and at least one cam rotatably mounted to said auxiliary frame and engaged at a periphery of said cam with said control means, said cam being drivingly interconnected to and rotatably driven by said gauge wheel relative to said control means to cause pivotal movement of said auxiliary and secondary frames about said respective axes and thereby generally vertical movement of said cutting head between said lowered cutting position and raised non-cutting position in response to rotation of said gauge wheel concurrently with continuous movement of said mobile chassis on the highway surface.

8. The machine as recited in claim 7, wherein said periphery of said cam has at least a first portion defining a first displaced position of said auxiliary frame and said secondary frame relative to one another and to said primary frame and thereby defining said lowered cutting position of said cutting head relative to the highway surface, said cam periphery also having at least a second portion circumferentially displaced from said first portion and defining a second displaced position of said auxiliary frame and said secondary frame relative to one another and to said primary frame and thereby defining said raised non-cutting position of said cutting head relative to the highway surface.

9. The machine as recited in claim 7, wherein said control means includes:

a cam follower; and an actuator mounted to said secondary frame and rotatably mounting said cam follower to engage said periphery of said cam, said actuator being operable for adjustably moving said cam follower toward and away from said periphery of said cam to dispose said cam follower at a given stationary position relative to said cam.

10. The machine as recited in claim 4, further comprising:

means interconnecting said primary and secondary frames and being operable for pivotally moving said secondary frame relative to said primary frame and thereby move said cutting head between a lowered operative condition and a raised inoperative condition.

11. A machine for repetitively cutting depressions of substantially equal dimensions and at equal spacings between the depressions in a highway surface, said machine comprising:

(a) a mobile chassis movable in a given direction on a highway surface and having a support frame pivotally movable about a first axis extending in generally transverse relation to the direction of movement of said mobile chassis;

(b) a cutter mechanism mounted to said pivotal support frame and including a cutting head continuously rotatable about a second axis extending in generally parallel relation to said first axis and being operable to cut a depression in the highway surface;

(c) an auxiliary frame connected to said support frame for pivotal movement about a third axis extending in generally parallel relation to said first and second axes;

(d) at least one gauge wheel mounted to said auxiliary frame and contacting the highway surface to support said auxiliary frame and thereby said support frame above the highway surface and to undergo rotational movement about a fourth axis extending in generally parallel relation to said first, second and third axes in response to movement of said mobile chassis in the given direction on the highway surface; and (e) means coupled to said gauge wheel for repetitively moving said auxiliary and support frames relative to one another and therewith said continuously rotating cutting head in a preset sequence, in response to rotation of said gauge wheel, between a lowered cutting position and a raised non-cutting position relative to the highway surface to repetitively cut depressions in the highway surface having the substantially equal desired dimensions at the substantially equal desired spacings, said repetitively moving means including (i) control means mounted to said support frame for adjustably presetting an initial position of said auxiliary frame relative to said support frame and thereby of said cutting head above the highway surface, and (ii) at least one cam rotatably mounted to said auxiliary frame and engaged at a periphery of said cam with said control means, said cam being drivingly interconnected to and rotatably driven by said gauge wheel relative to said control means to cause pivotal movement of said auxiliary and support frames about said respective axes and thereby generally vertical movement of said cutting head between said lowered cutting position and raised non-cutting position in response to rotation of said gauge wheel concurrently with continuous movement of said mobile chassis on the highway surface.

12. The machine as recited in claim 11, wherein said mobile chassis includes:

an elongated primary frame; and spaced apart front and rear wheels rotatably mounted to and movably supporting said primary frame above the highway surface for movement on the highway surface.

13. The machine as recited in claim 12, wherein said support frame is a secondary frame pivotally connected to said primary frame between and spaced from said front and rear wheels.

14. The machine as recited in claim 12, said cutter mechanism includes drive means mounted to said secondary frame and being drivingly interconnected to said cutting head for rotatably driving said cutting head at a desired speed to cut the depression in the highway surface.

15. The machine as recited in claim 13, further comprising:

means interconnecting said primary and secondary frames and being operable for pivotally moving said secondary frame relative to said primary frame and thereby move said cutting head between a lowered operative condition and a raised inoperative condition.

16. A machine for repetitively cutting depressions of substantially equal dimensions and at equal spacings between the depressions in a highway surface, said machine comprising:

(a) a mobile chassis movable in a given direction on a highway surface and having a support frame pivotally movable about a first axis extending in generally transverse relation to the direction of movement of said mobile chassis, said mobile chassis including an elongated primary frame and spaced apart front and rear wheels rotatably mounted to and movably supporting said primary frame above the highway surface for movement on the highway surface, said support frame being a secondary frame pivotally connected to said primary frame between and spaced from said front and rear wheels;

(b) a cutter mechanism mounted to said secondary frame and including a cutting head continuously rotatable about a second axis extending in generally parallel relation to said first axis and being operable to cut a depression in the highway surface;

(c) an auxiliary frame connected to said secondary frame for pivotal movement about a third axis extending in generally parallel relation to said first and second axes;

(d) at least one gauge wheel mounted to said auxiliary frame and contacting the highway surface to support said auxiliary frame and thereby said support frame above the highway surface and to undergo rotational movement about a fourth axis extending in generally parallel relation to said first, second and third axes in response to movement of said mobile chassis in the given direction on the highway surface; and (e) means coupled to said gauge wheel for repetitively moving said auxiliary and support frames relative to one another and therewith said continuously rotating cutting head in a preset sequence, in response to rotation of said gauge wheel, between a lowered cutting position and a raised non-cutting position relative to the highway surface to repetitively cut depressions in the highway surface having the substantially equal desired dimensions at the substantially equal desired spacings, said repetitively moving means including control means mounted to said secondary frame for adjustably presetting an initial position of said auxiliary frame relative to said secondary frame and thereby of said cutting head above the highway surface, and at least one cam rotatably mounted to said auxiliary frame and engaged at a periphery of said cam with said control means, said cam being drivingly interconnected to and rotatably driven by said gauge wheel relative to said control means to cause pivotal movement of said auxiliary and secondary frames about said respective axes and thereby generally vertical movement of said cutting head between said lowered cutting position and raised non-cutting position in response to rotation of said gauge wheel concurrently with continuous movement of said mobile chassis on the highway surface.

17. The machine as recited in claim 16, wherein said periphery of said cam has at least a first portion defining a first displaced position of said auxiliary frame and said secondary frame relative to one another and to said primary frame and thereby defining said lowered cutting position of said cutting head relative to the highway surface, said cam periphery also having at least a second portion circumferentially displaced from said first portion and defining a second displaced position of said auxiliary frame and said secondary frame relative to one another and to said primary frame and thereby defining said raised non-cutting position of said cutting head relative to the highway surface.

18. The machine as recited in claim 17, wherein said control means includes:

a cam follower; and an actuator mounted to said secondary frame and rotatably mounting said cam follower to engage said periphery of said cam, said actuator being operable for adjustable moving said cam follower toward and away from said periphery of said cam to disposed said cam follower at a given stationary position relative to said cam.

19. A method of repetitively cutting depressions of substantially equal dimensions and at equal spacings between the depressions in a highway surface, said method comprising the steps of:

(a) continuously moving in a given direction on a highway surface a mobile chassis supporting a cutter mechanism having a cutting head rotatable about a first axis extending transversely to the given direction and capable of cutting a depression in the highway surface;

(b) concurrently with continuous movement of the mobile chassis, continuously rotating the cutting head relative to the mobile chassis about said first axis;

(c) continuously gauging the movement of the mobile chassis by engaging a rotatable gauge wheel with the highway surface to cause rotation of the wheel above a second axis in correspondence with the movement of the chassis; and (d) repetitively moving, in response to rotation of the gauge wheel in gauging of the continuous movement of the mobile chassis, the continuously rotating cutting head in a preset sequence between a lowered cutting position and raised noncutting position relative to the highway surface to repetitively cut depressions in the highway surface having the substantially equal desired dimensions at the substantially equal desired spacings, said preset sequence defining the repetitive movement of the cutting head being defined by providing circumferentially displaced peripheral portions on a periphery of at least one cam, said at least one cam being rotatably driven above a third axis by rotation of the gauge wheel, said third axis being spaced from said first and second axes.

* * * * *